US007107739B1

(12) United States Patent
Pienta et al.

(10) Patent No.: US 7,107,739 B1
(45) Date of Patent: Sep. 19, 2006

(54) CROSS-FEED WRAPPING APPARATUS AND PROCESS

(75) Inventors: David J. Pienta, Lambertville, MI (US); Daniel J. Pienta, Lambertville, MI (US); David M. Pienta, Lambertville, MI (US)

(73) Assignee: Five Brothers Properties, LTD, Lambertville, MI (US)

( * ) Notice: Subject to any disclaimer, the term of this patent is extended or adjusted under 35 U.S.C. 154(b) by 0 days.

(21) Appl. No.: 11/006,271

(22) Filed: Dec. 7, 2004

(51) Int. Cl.
*B65B 11/18* (2006.01)
*B65B 11/04* (2006.01)

(52) U.S. Cl. ..... 53/465; 53/504; 53/214; 53/389.3

(58) Field of Classification Search ..... 53/214, 53/211, 210, 465, 389.1–389.5, 372.9, 503, 53/504; B65B 11/18, 11/04
See application file for complete search history.

(56) References Cited

U.S. PATENT DOCUMENTS

| | | | | | |
|---|---|---|---|---|---|
| 2,738,062 | A | * | 3/1956 | Edgecombe | 53/214 |
| 3,342,014 | A | * | 9/1967 | Prager | 53/214 |
| 3,380,223 | A | * | 4/1968 | Jasper et al. | 53/389.3 |
| 3,429,097 | A | * | 2/1969 | Jasper et al. | 53/214 |
| 4,217,745 | A | * | 8/1980 | Watzka | 53/389.3 |
| 4,596,108 | A | * | 6/1986 | Piesen et al. | 53/211 |
| 4,674,260 | A | * | 6/1987 | Rasmussen et al. | 53/214 |
| 4,716,709 | A | * | 1/1988 | Lamb et al. | 53/214 |
| 4,736,567 | A | | 4/1988 | Pienta | |
| 4,882,892 | A | | 11/1989 | Pienta | |
| 5,299,411 | A | * | 4/1994 | Yamamoto et al. | 53/211 |
| 5,546,729 | A | | 8/1996 | Pienta | |
| 5,791,119 | A | | 8/1998 | Pienta | |
| 6,347,498 | B1 | | 2/2002 | Pienta et al. | |
| 2002/0148922 | A1 | * | 10/2002 | Kadota et al. | 242/532.3 |

* cited by examiner

*Primary Examiner*—Stephen F. Gerrity
(74) *Attorney, Agent, or Firm*—MacMillan, Sobanski & Todd, LLC

(57) ABSTRACT

A cross-feed wrapping apparatus and process for wrapping an object such as a paper roll including a stand assembly for supporting a paper wrapper roll, a feeder assembly for moving a paper wrapper section in a first direction, and a knife assembly for cutting the paper wrapper section from the paper wrapper roll. The apparatus has a table assembly including a conveyor assembly for moving the paper wrapper section in the first direction until the paper wrapper section is centered with respect to the paper roll. The table assembly includes a table roller assembly for moving the paper wrapper section in a second direction perpendicular to the first direction toward the paper roll. A vacuum assembly holds the paper wrapper section in the centered position prior to the wrapping of the paper roll. The apparatus includes a support assembly for the paper roll having a support roller assembly for moving the object as the paper roll is being wrapped by the paper wrapper section to produce a wrapped paper roll.

11 Claims, 11 Drawing Sheets

CROSS-FEED WRAPPING APPARATUS AND PROCESS

CROSS-REFERENCE TO RELATED APPLICATIONS

Not Applicable.

STATEMENT REGARDING FEDERALLY SPONSORED RESEARCH OR DEVELOPMENT

Not Applicable.

TECHNICAL FIELD

The present invention relates generally to apparatus and process for wrapping an object with a protective material. More specifically, the invention relates to a cross-feed wrapping apparatus and process for wrapping a paper roll with a protective paper wrapper.

BACKGROUND OF THE INVENTION

Wrapping machines for large objects such as paper rolls are known in the art. It has been found that these prior machines are large, slow and require a high degree of manual labor to operate. Accordingly, there is a need for a relatively small, fast and automated wrapping apparatus. The present invention satisfies these and other needs.

BRIEF SUMMARY OF THE INVENTION

The present invention is a cross-feed wrapping apparatus and process to wrap an object such as a paper roll. The apparatus includes a stand assembly for supporting a paper wrapper roll. The apparatus also includes a feeder assembly for moving a paper wrapper section in a first direction from the paper wrapper roll and a knife assembly for cutting the paper wrapper section from the paper wrapper roll. A glue applicator assembly is mounted adjacent to the feeder assembly for applying glue to the paper wrapper section.

The apparatus has a table assembly including a conveyor assembly for moving the paper wrapper section in the first direction until the paper wrapper section is centered with respect to the paper roll to be wrapped with the paper wrapper section. The table assembly further includes a table roller assembly for moving the paper wrapper section in a second direction perpendicular to the first direction toward the paper roll.

A vacuum bed assembly is positioned adjacent to the table assembly for applying a vacuum to the paper wrapper to position the paper wrapper section with respect to the paper roll. The vacuum assembly holds the paper wrapper section in the centered position prior to the wrapping of the paper roll.

The apparatus includes a support assembly for the paper roll having a support roller assembly for moving the object as the paper roll is being wrapped by the paper wrapper section.

The primary object of the present invention is to provide a cross-feed wrapping apparatus that is relatively small, fast and automated.

Other objects and advantages of the present invention will become apparent to those skilled in the art upon a review of the following detailed description of the preferred embodiments and the accompanying drawings.

DETAILED DESCRIPTION OF THE INVENTION

Figure 1:
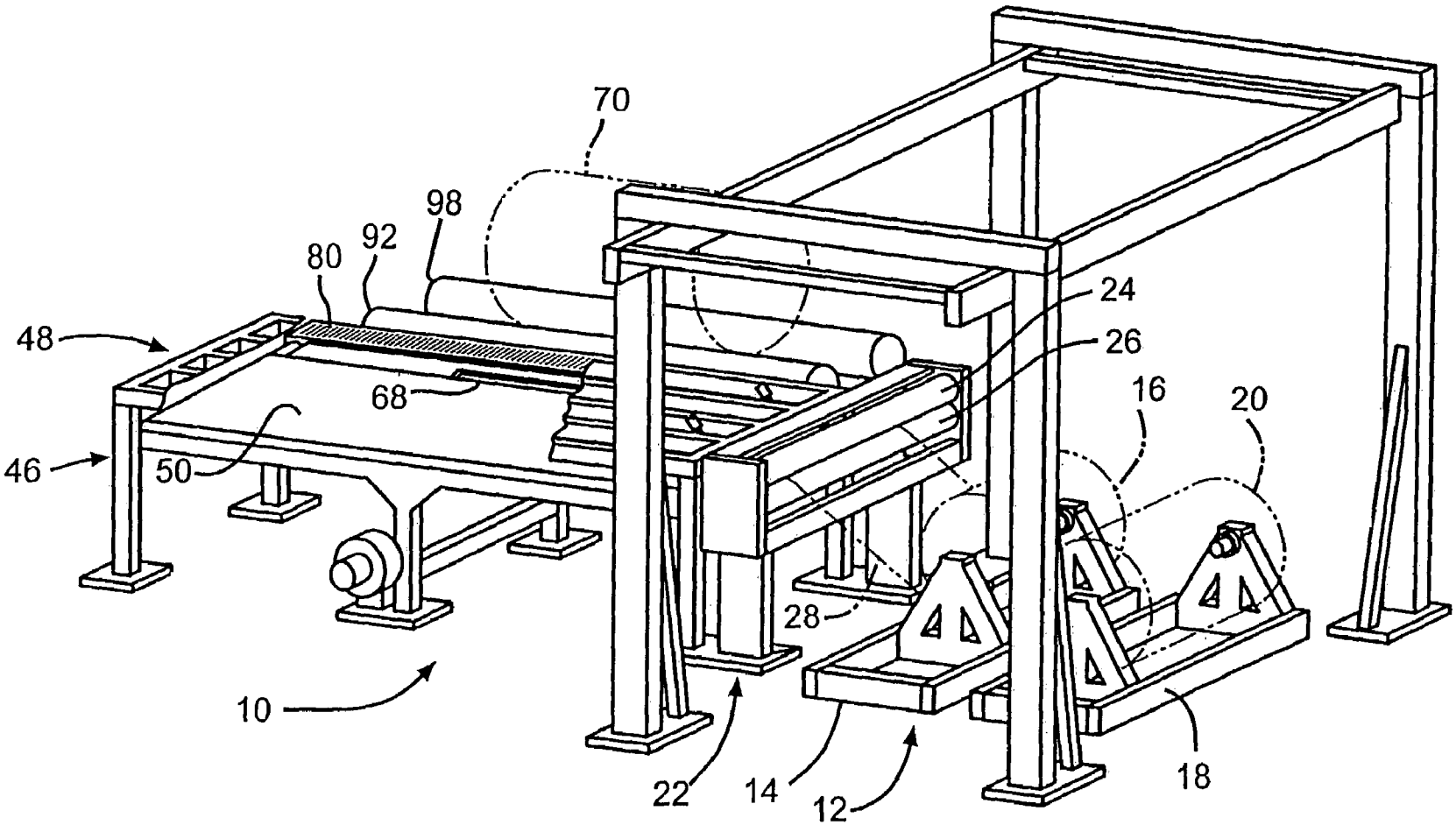
FIG. 1 is a is a perspective view of a cross-feed wrapping apparatus according to the present invention.

The preferred embodiments and best mode of the present invention will now be described in detail with reference being made to the drawings. In the drawings, the cross-feed wrapping apparatus of the present invention is indicated generally by the reference number "10".

Referring to FIG. 1, the apparatus 10 has a stand assembly 12 that includes a first stand 14 for rotatably positioning a first paper wrapper roll 16 and a second stand 18 for rotatably positioning a second paper wrapper roll 20. In a preferred embodiment, the first and second paper wrapper rolls 16 and 20 are kraft paper rolls. The first and second paper wrapper rolls 16 and 20 can have widths in the range of 8 inches to 140 inches and diameters in the range of 30 inches to 60 inches. Further, the first and second paper wrapper rolls 16 and 20 can have different widths. Accordingly, the first and second stands 14 and 18 can have various shapes and sizes to accommodate the various size first and second paper wrapper rolls 16 and 20.

Figure 2:
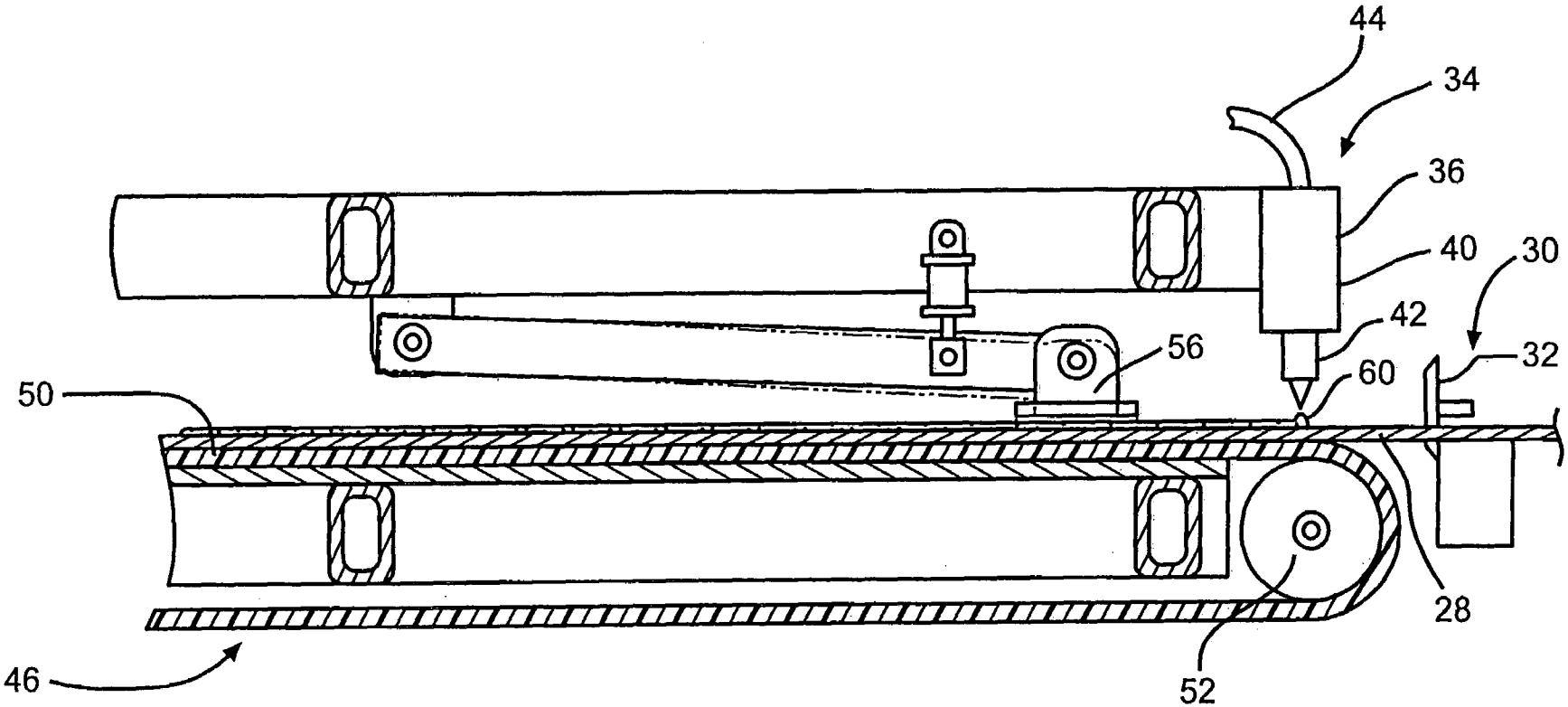
FIG. 2 is a cross-sectional view of a feeder assembly, a glue applicator assembly and a table assembly according to the present invention.

Referring now to FIGS. 1 and 2, the apparatus 10 has a feeder assembly 22 including two feeder rollers 24 and 26 that are rotatably mounted one above the other. The feeder rollers 24 and 26 engage and move a paper wrapper section 28 from, for example, the first paper wrapper roll 16. The feeder assembly 22 further has a longitudinally extending knife assembly 30 including a movably mounted knife 32 for cutting the paper wrapper section 28 from the first paper roll 16.

Figure 5:
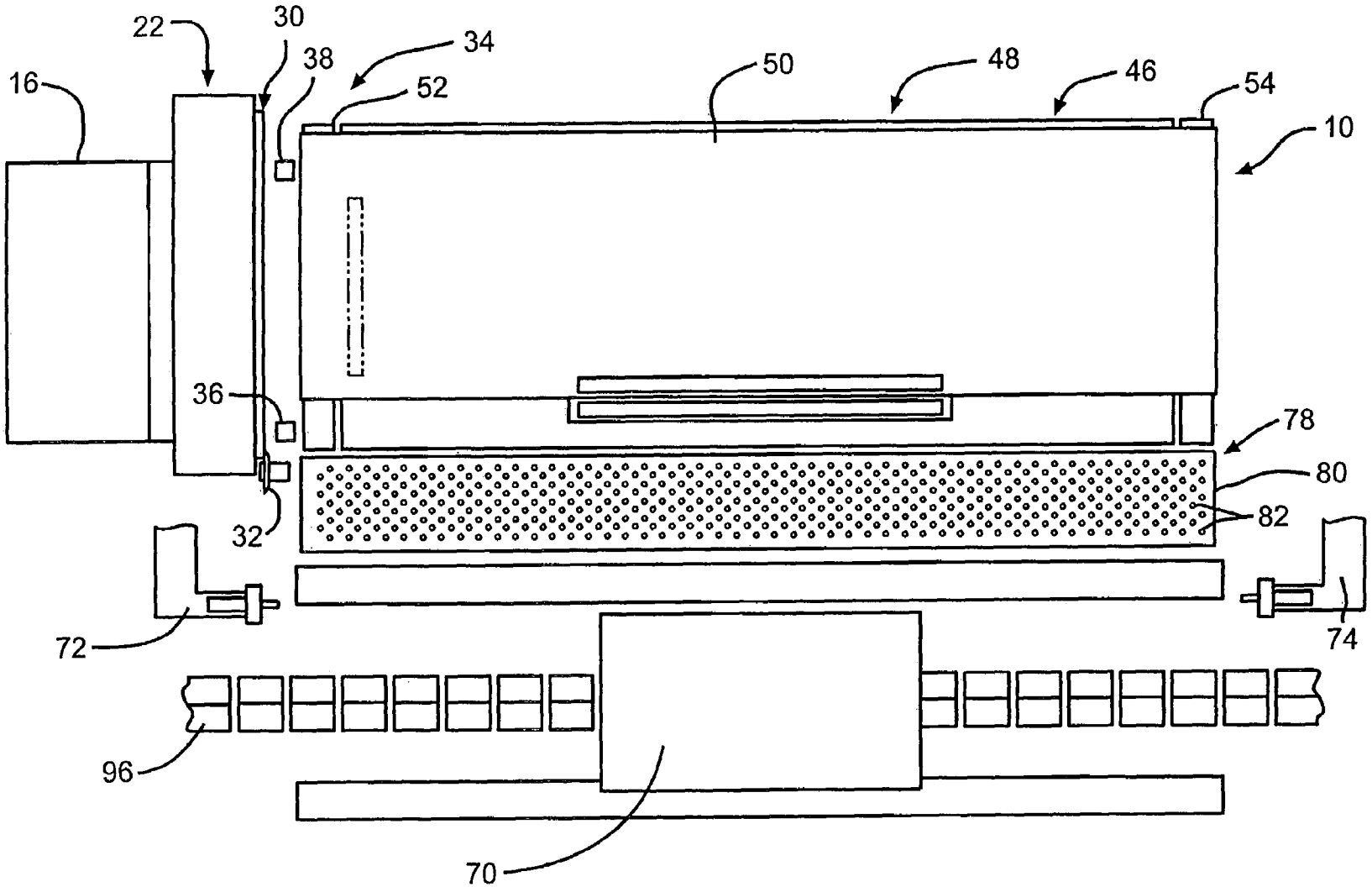
FIG. 5 is a plan view of the present apparatus and process at the beginning of a wrapping operation.

Referring to FIGS. 2 and 5, the apparatus 10 has a glue applicator assembly 34 including two glue applicators 36 and 38 for applying glue to separate portions of the paper wrapper section 28. As shown in FIG. 2, the first and second glue applicators 36 and 38 each includes a pivotally mounted glue head 40 having a nozzle 42 in communication with a glue source (not shown) through a conduit 44.

Figure 6:
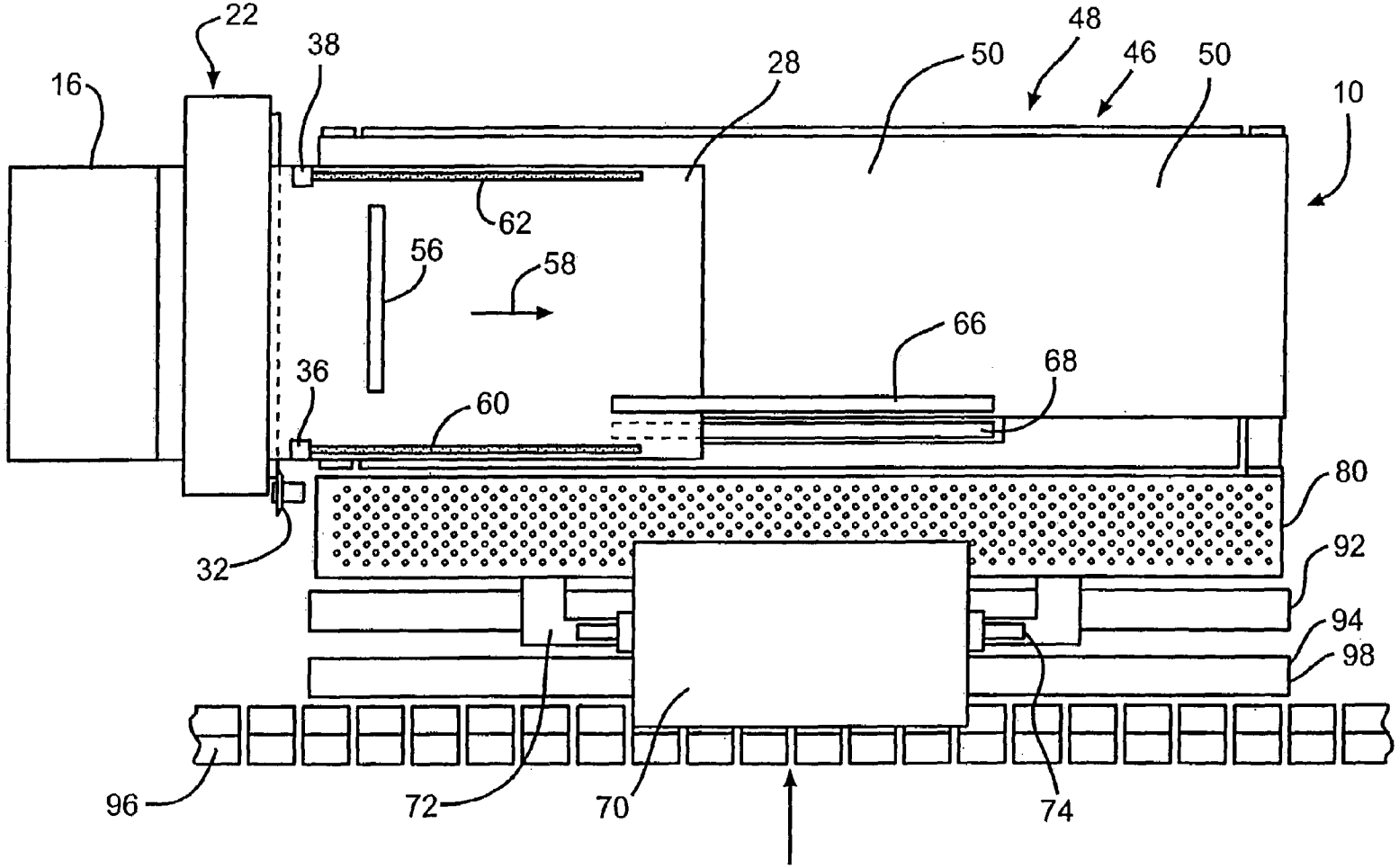
FIG. 6 is a plan view thereof showing a paper wrapper section being moved in a first direction by the feeder assembly to the table assembly.

Referring now to FIGS. 1, 2, 5 and 6, the apparatus 10 has a table assembly 46 including a conveyor assembly 48 having a conveyor belt 50 actuated by two conveyor rollers 52 and 54. The table assembly 46 also includes a clamp 56 for holding the paper wrapper section 28 as it leaves the feeder assembly 22 and is positioned on the conveyor belt 50 during cutting by the knife 32. The conveyor belt 50 moves the paper wrapper section 28 in a first direction as shown in FIG. 6 by an arrow 58. During this operation, two beads of glue 60 and 62 are applied to the paper wrapper section 28 by the first and second glue applicators 36 and 38, respectively.

Figure 3:
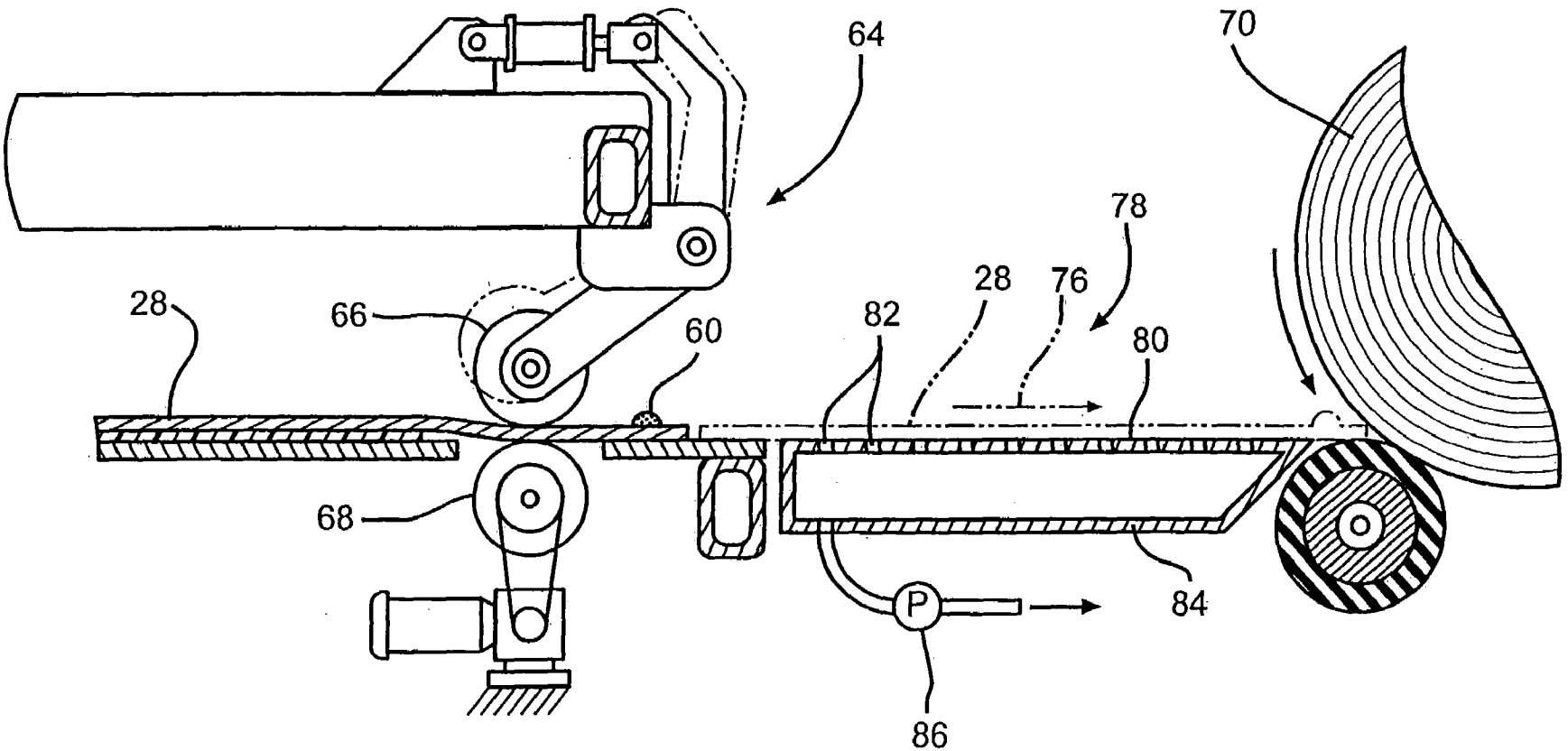
FIG. 3 is a cross-sectional view of a table assembly, a table roller assembly, a vacuum assembly and a support assembly upon which a paper roll is positioned according to the present invention.
Figure 7:
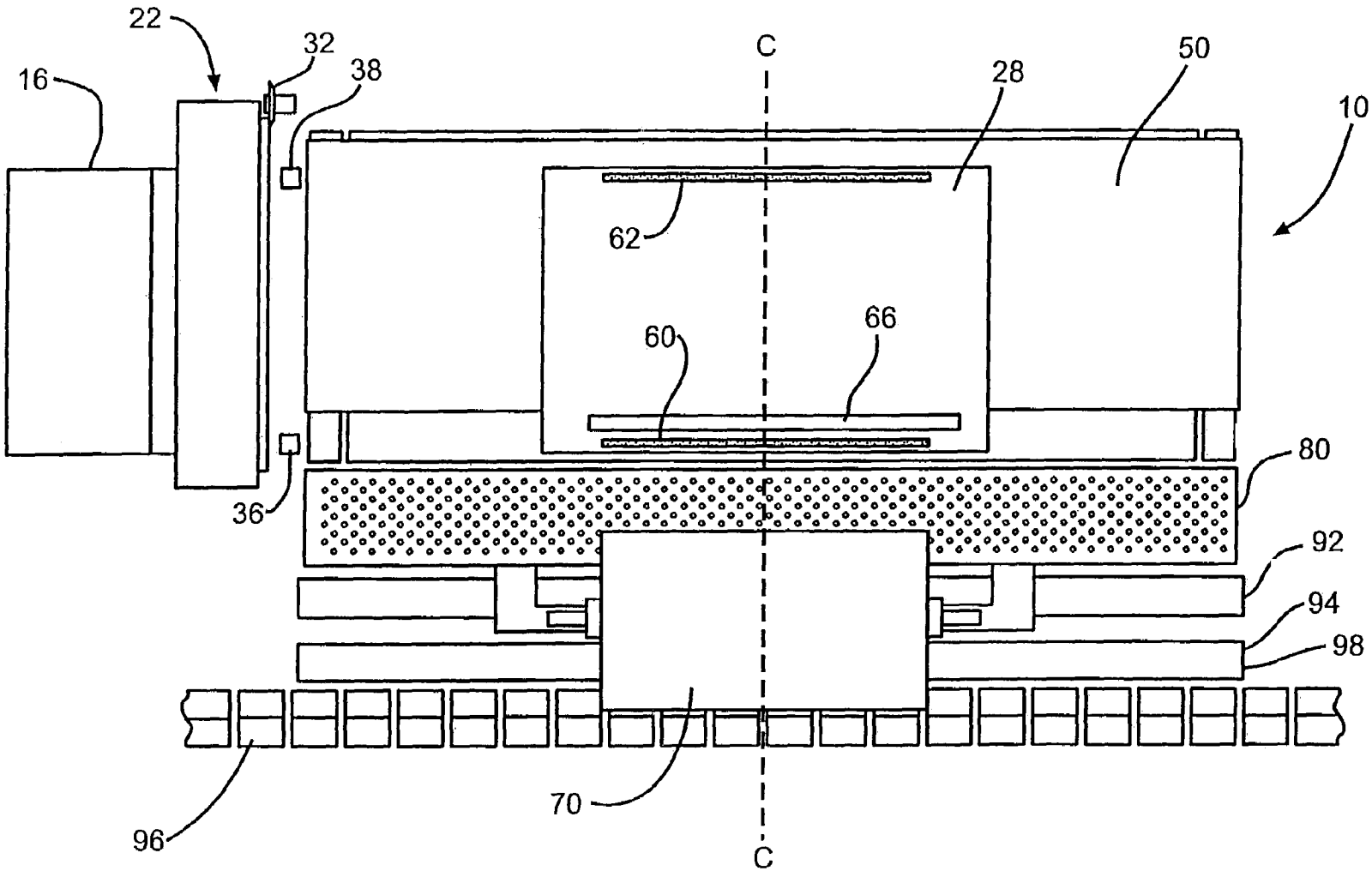
FIG. 7 is a plan view thereof showing the paper wrapper section being centered in position on the table assembly.
Figure 8:
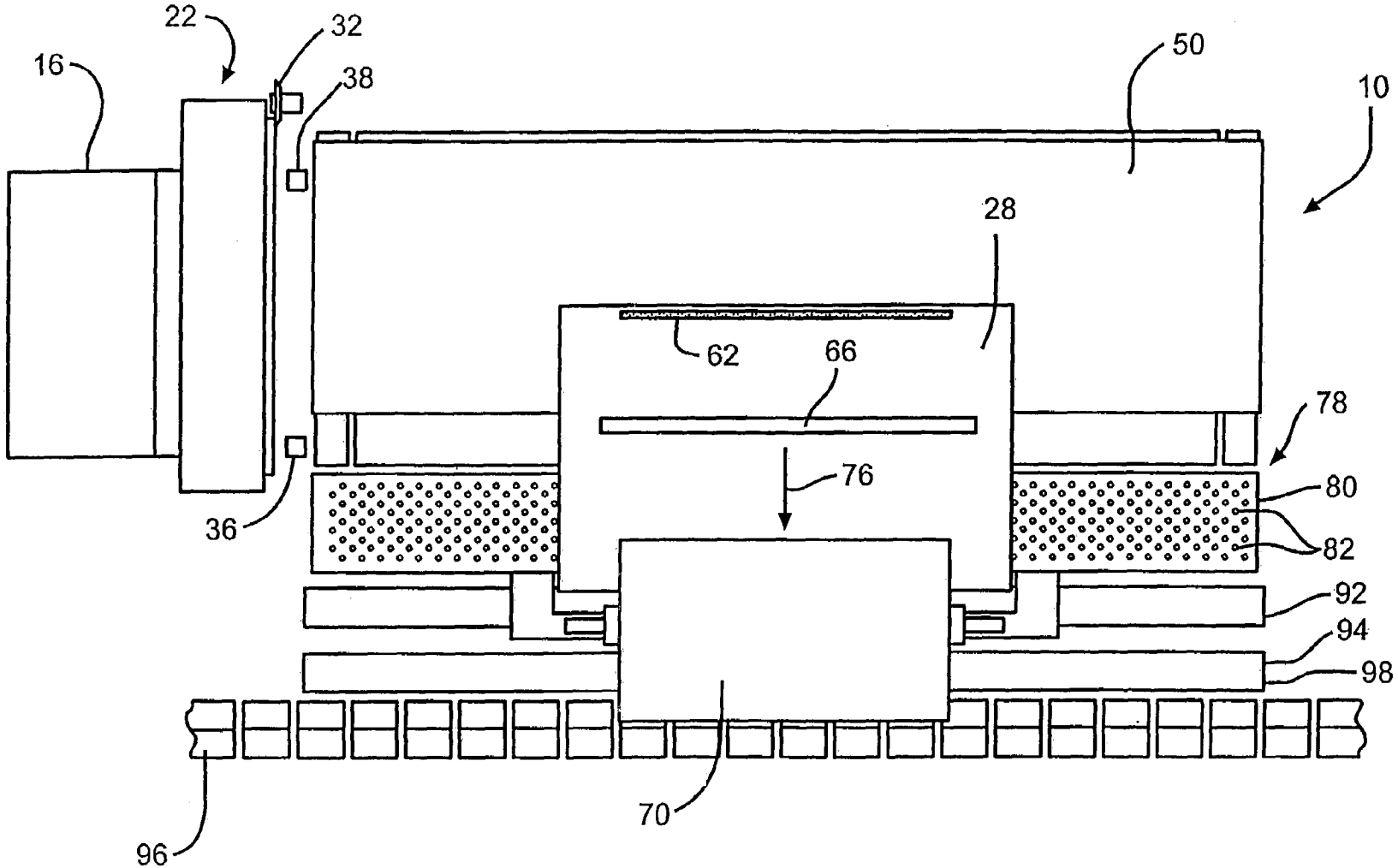
FIG. 8 is a plan view thereof showing the paper wrapper section being moved in a second direction perpendicular to the first direction toward the paper roll.

Referring to FIGS. 3 and 5–8, the table assembly 46 includes a table roller assembly 64 having two pivotally and rotatably mounted table rollers 66 and 68 for engaging and moving the paper wrapper section 28 that is positioned between the rollers. As shown in FIG. 6, the paper wrapper section 28 is moved in the first direction 58 until it is positioned between the table rollers 66 and 68. The paper wrapper section 28 is also positioned so that it is centered along a centerline C as shown in FIG. 7. This centers the paper wrapper section 28 with respect to an object such as a paper roll 70, which is to be wrapped by the paper wrapper section 28. As shown in FIG. 5, the apparatus 10 has a pair of measurement arms 72 and 74 for sizing the paper roll 70. This information is used to determine the size of the paper wrapper section 28. As shown in FIGS. 3 and 8, the table rollers 66 and 68 engage and move the paper wrapper section 28 in a second direction as indicated by an arrow 76 that is perpendicular to the first direction 58 toward the paper roll 70. Thus, the apparatus 10 provides cross-feed wrapping of the paper roll 70.

As shown in FIGS. 3, 5 and 8, the apparatus 10 includes a vacuum bed assembly 78 having a vacuum bed 80 including a plurality of openings 82. A negative pressure chamber 84 is connected to a pump 86 that varies the vacuum pressure at the openings 82. As the paper wrapper section 28 is moved toward the paper roll 70 onto the vacuum bed 80, a vacuum is applied through the openings 82 to hold the paper wrapper section 28 in a centered position with respect to the paper roll 70.

Figure 4:
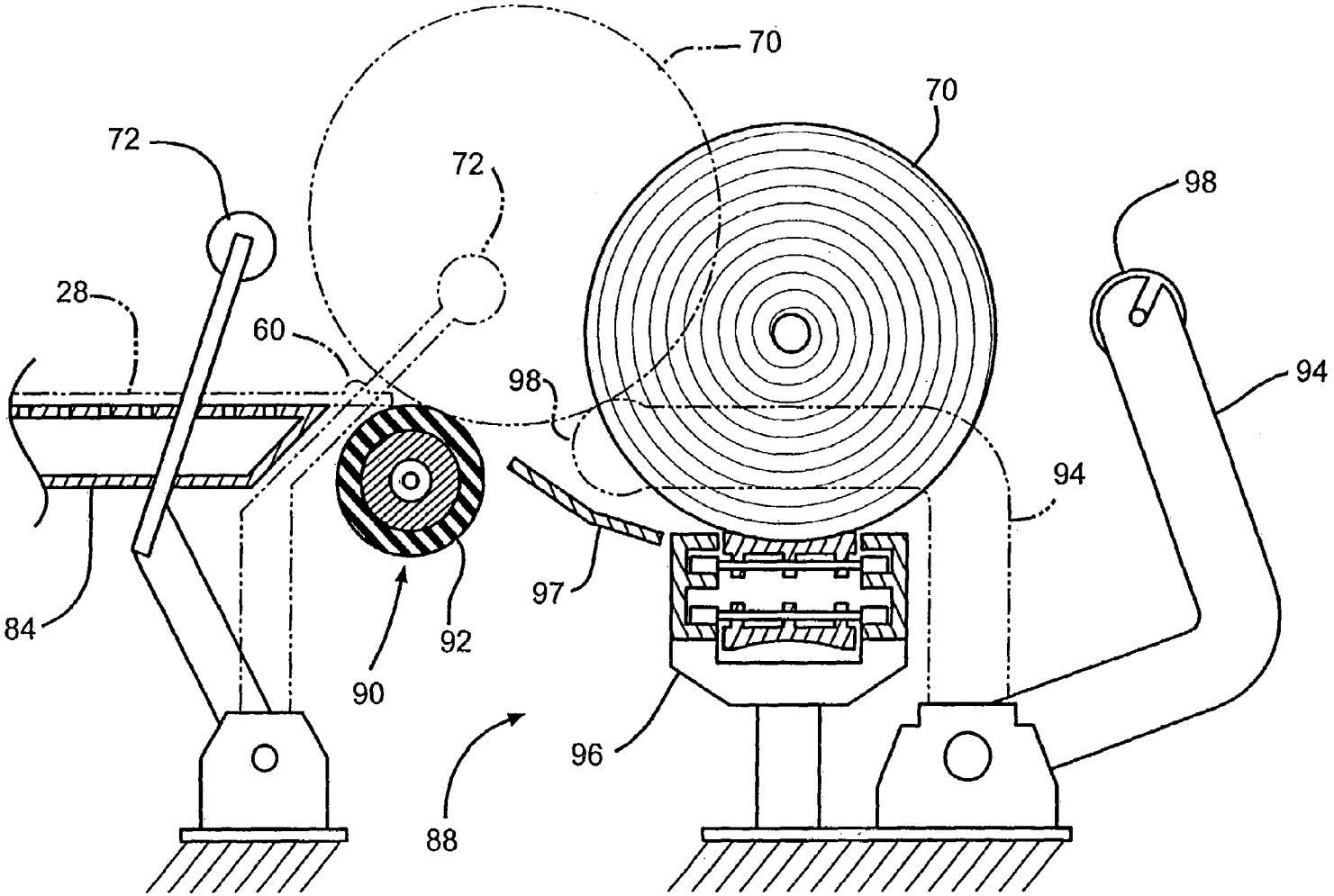
FIG. 4 is a cross-sectional view of a vacuum assembly and a support assembly showing a paper roll being positioned on the support assembly according to the present invention.

Referring now to FIG. 4, the apparatus 10 has a support assembly 88 that includes a support roller assembly 90 having a rotatably mounted support roller 92. The support assembly further includes a pivotally mounted pusher arm 94 that pushes the paper roll 70 from a paper roll conveyor 96 onto the support roller 92. A ramp 97 is positioned between the paper roll conveyor 96 and the support roller 92 to support and guide the paper roll 70. The pusher arm 94 includes a rotatably mounted pusher arm roller 98 that engages and positions the paper roll 70 along with the support roller 92 during the wrapping operation. The support roller 92 engages and moves the paper roll 70 and the pusher arm roller 98 supports and allows the paper roll 70 to rotate.

Figure 9:
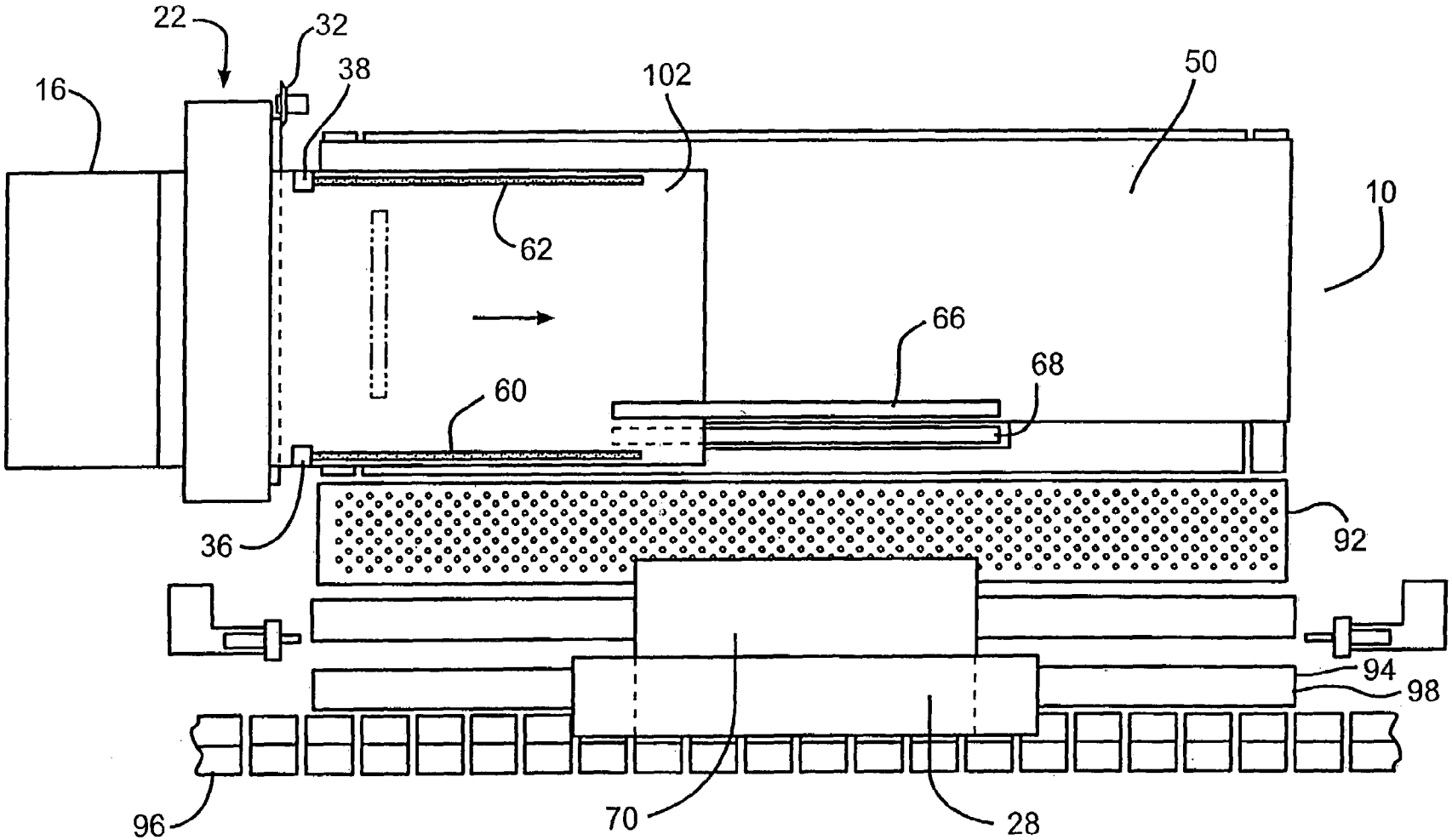
FIG. 9 is a plan view thereof similar to the view of FIG. 6 showing a second paper wrapper section being moved in a first direction by the feeder assembly to the table assembly.
Figure 10:
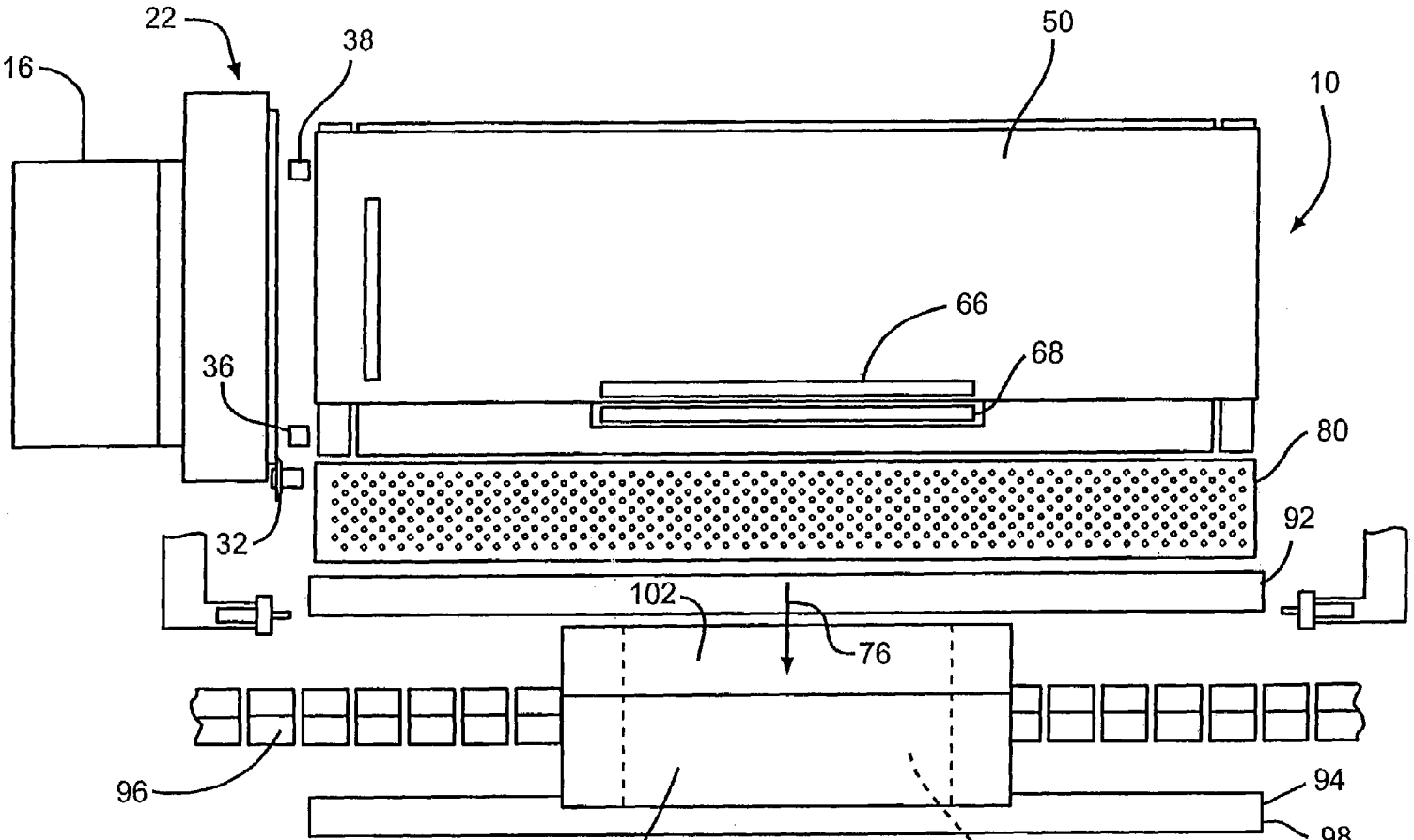
FIG. 10 is a plan view thereof showing the second paper wrapper section being positioned on the paper roll.

Referring to FIGS. 8–11, the paper wrapper section 28 is released from the vacuum bed 80 when the vacuum is evacuated. The paper wrapper section 28 engages the paper roll 70 that is being rotated by the support roller 92. The first bead of glue 60 attaches the paper wrapper section 28 to the paper roll 70 which causes the paper wrapper section 28 to be carried by the paper roll 70. The second bead of glue 62 is then attached to the paper roll 70. As shown in FIGS. 9 and 10, a second paper wrapper section 102 is dispensed by the feeder assembly 22, the table assembly 46 and the vacuum bed assembly 78 and delivered to the paper roll 70 as described above with respect to the first paper wrapper section 28 to complete the wrapping of the paper roll 70. Additional paper wrapper sections can be dispensed and delivered to the paper roll 70 depending on the size of the paper roll 70. The pusher arm 94 then pivots back to the upright position as shown in FIG. 4 to allow the wrapped paper roll 70 to return to the paper roll conveyor 96. As shown in FIG. 10, ends of the first and second paper wrapper sections 28 and 102 extend beyond the paper roll 70. The ends will be positioned against the ends of the paper roll 70 in a subsequent operation.

Figure 11:
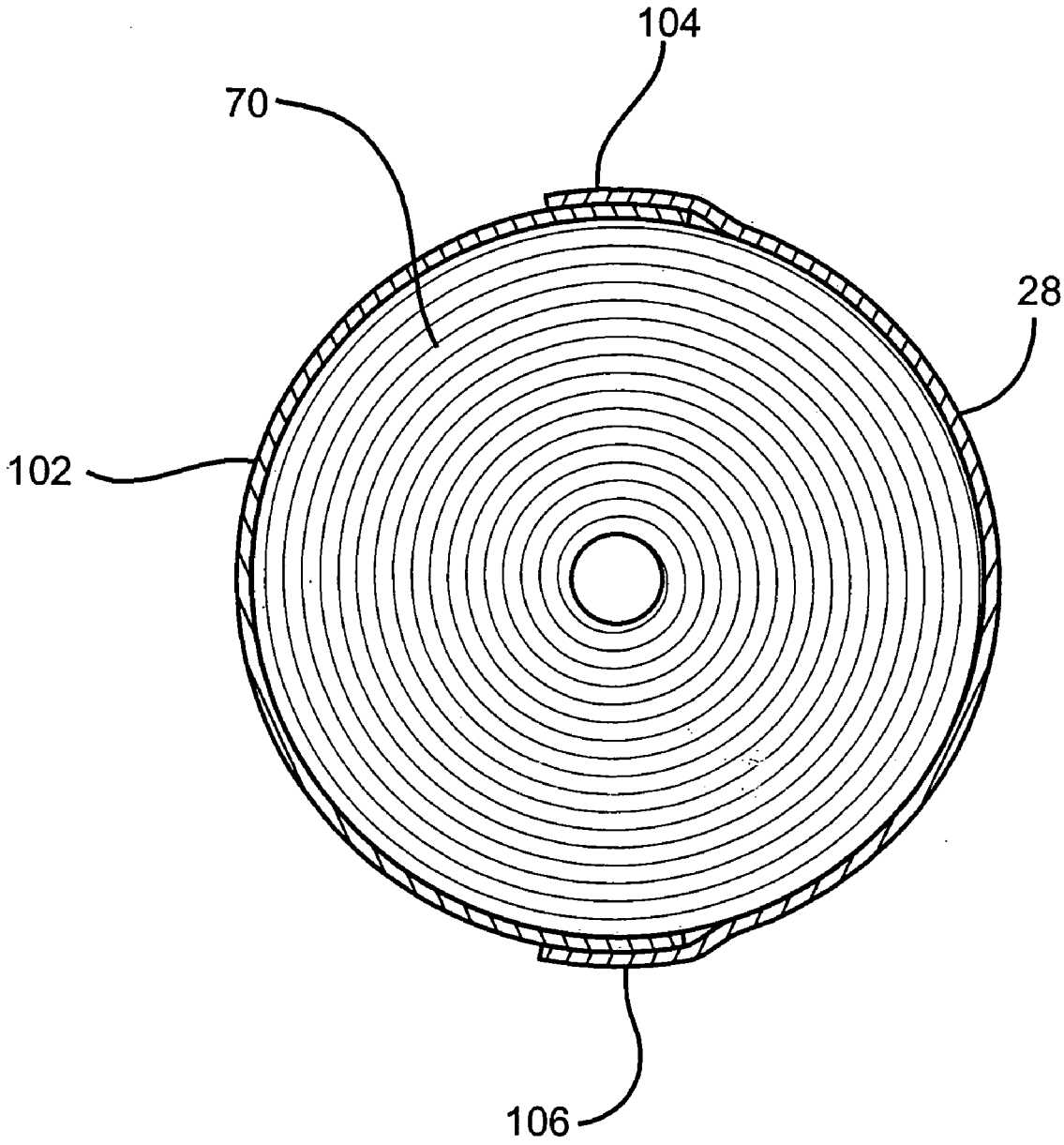
FIG. 11 is a cross-sectional view of a wrapped paper roll.

As shown in FIG. 11, the wrapped paper roll 70 includes the first and second paper wrapper sections 28 and 102 having overlapping sections 104 and 106. The overlapping sections 104 and 106 prevent damaging materials such as dirt from contacting the paper roll 70.

It has been found that the cross-feed wrapping apparatus 10 of the present invention is relatively small, fast and automated as compared to prior machines. This allows the apparatus 10 to be placed in a smaller space, increases production and requires less manual labor to operate.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense.

We claim:

1. A cross-feed wrapping apparatus comprising:

a stand assembly for supporting a paper wrapper roll for producing a paper wrapper section;

a pair of measurement arms for sizing an object to be wrapped by the paper wrapping section to determine the size of the paper wrapper section;

a feeder assembly for moving the paper wrapper section in a generally horizontal first direction from the paper wrapper roll and a knife assembly for cutting the paper wrapper section from the paper wrapper roll;

a glue applicator assembly for applying glue to the paper wrapper section;

a table assembly having a conveyor assembly for moving the paper wrapper section in the first direction until the paper wrapper section is centered with respect to the object and a table roller assembly for moving the paper wrapper section in a generally horizontal second direction generally perpendicular to the first direction toward the object;

a vacuum bed assembly for applying a vacuum to the paper wrapper section to position the paper wrapper section with respect to the object; and a support assembly for the object having a support roller assembly for moving the object as the object is being wrapped by the paper wrapper section.

2. The apparatus of claim 1, wherein the stand assembly has at least one stand for rotatably positioning a paper wrapper roll.

3. The apparatus of claim 1, wherein the feeder assembly has two feeder rollers rotatably mounted one above the other for engaging the paper wrapper section.

4. The apparatus of claim 1, wherein the knife assembly is movably mounted on the feeder assembly.

5. The apparatus of claim 1, wherein the glue applicator assembly has at least two glue applicators for applying glue to separate portions of the paper wrapper section.

6. The apparatus of claim 1, wherein the conveyor assembly has a conveyor belt actuated by at least two conveyor rollers.

7. The apparatus of claim 1, wherein the table roller assembly has at least two table rollers rotatably mounted one above the other for engaging the paper wrapper section.

8. The apparatus of claim 1, wherein the vacuum bed assembly has a plurality of openings in communication with a negative pressure chamber.

9. The apparatus of claim 1, wherein the support assembly has a pusher arm for pushing the object to the support roller assembly.

10. The apparatus of claim 9, wherein the pusher arm has a rotatable pusher arm roller for supporting the object.

11. A process for producing a wrapped object using a cross-feed wrapping apparatus comprising:

sizing an object to be wrapped by a paper wrapper section with a pair of measurement arms;

moving the paper wrapper section in a generally horizontal first direction on a conveyor assembly until the paper wrapper section is centered with respect to the object;

applying glue with a glue applicator assembly to the paper wrapper section;

moving the paper wrapper section on the conveyor assembly in a generally horizontal second direction generally perpendicular to the first direction toward the object;

applying a vacuum with a vacuum bed assembly to the paper wrapper section to position the paper wrapper section with respect to the object; and rotating the object on a support assembly while applying the paper wrapper section to the object to produce a wrapped object having the paper wrapper section adhered by the glue to the object.

* * * * *